US008245904B2

(12) United States Patent
Dyer

(10) Patent No.: US 8,245,904 B2
(45) Date of Patent: Aug. 21, 2012

(54) DOUBLE PARALLEL FOLDED MAILER HAVING AN INTEGRATED RETURN POSTCARD

(75) Inventor: Michael Clark Dyer, Irvine, CA (US)

(73) Assignee: Moore Wallace North America, Inc., Stamford, CT (US)

( * ) Notice: Subject to any disclaimer, the term of this patent is extended or adjusted under 35 U.S.C. 154(b) by 791 days.

(21) Appl. No.: 12/258,623

(22) Filed: Oct. 27, 2008

(65) Prior Publication Data

US 2010/0102108 A1 Apr. 29, 2010

(51) Int. Cl.
*B65D 27/06* (2006.01)
*B65D 27/00* (2006.01)

(52) U.S. Cl. ..... 229/305; 229/300; 229/301; 229/70

(58) Field of Classification Search ..... 229/305
See application file for complete search history.

(56) References Cited

U.S. PATENT DOCUMENTS

| | | | | |
|---|---|---|---|---|
| 444,979 | A | | 1/1891 | Harrison et al. |
| 661,690 | A | | 11/1900 | Forney |
| 690,793 | A | | 1/1902 | Taylor |
| 975,737 | A | | 11/1910 | Utley |
| 1,032,648 | A | | 7/1912 | Berwick |
| 1,044,123 | A | | 11/1912 | Berwick |
| 1,472,142 | A | | 10/1923 | Shurick |
| 1,698,628 | A | | 1/1929 | Gonzales |
| 2,016,063 | A | | 10/1935 | White |
| 2,116,230 | A | | 5/1938 | Berkowitz |
| 2,129,192 | A | | 9/1938 | Berkowitz |
| 3,229,893 | A | * | 1/1966 | Stein ..... 229/301 |
| 3,652,007 | A | * | 3/1972 | MacDougall ..... 229/304 |
| 3,858,792 | A | | 1/1975 | Volkert |
| 4,284,230 | A | | 8/1981 | Schultz |
| 4,524,903 | A | | 6/1985 | Vath |
| 4,651,920 | A | | 3/1987 | Stenner |
| 4,927,072 | A | | 5/1990 | Jenkins et al. |
| 4,928,875 | A | | 5/1990 | Hutchinson |

(Continued)

OTHER PUBLICATIONS

United States Patent and Trademark Office, "Office Action," issued in connection with corresponding U.S. Appl. No. 12/363,382, on Jul. 22, 2011 (17 pages).

*Primary Examiner* — Nathan J Newhouse
*Assistant Examiner* — Derek Battisti
(74) *Attorney, Agent, or Firm* — Hanley, Flight & Zimmerman, LLC

(57) ABSTRACT

Forms having return postcards are described herein. An example form to be folded as an outgoing mailer includes a quadrate sheet of paper having a first face opposite a second face, substantially parallel top and bottom edges, and substantially parallel first and second side edges, where the first and second side edges are substantially perpendicular to the top and bottom edges. The form includes at least first, second, and third fold lines parallel to the top and bottom edges to divide the sheet into at least first, second, third, and fourth panels. The second face of the second panel and the second face of the third panel fold onto each other to form a postcard when the sheet is double parallel folded about the fold lines. At least a first portion of the second face of the second panel and at least a second portion of the second face of the third panel include a first adhesive area to couple the second and third panels when the sheet is folded along the fold lines.

24 Claims, 11 Drawing Sheets

U.S. PATENT DOCUMENTS 5,125,562 A 6/1992 Bendel
5,169,060 A 12/1992 Tighe et al.
5,288,014 A 2/1994 Meyers et al.
5,289,972 A 3/1994 Sauerwine et al.
5,346,123 A * 9/1994 Lombardo ..... 229/305
5,370,302 A 12/1994 Dyer
5,375,764 A 12/1994 Sauerwine
5,376,048 A 12/1994 Whiteside
5,402,934 A 4/1995 Sauerwine
5,421,620 A 6/1995 Sauerwine
5,425,500 A 6/1995 Sauerwine
5,513,795 A 5/1996 Sauerwine
5,553,774 A 9/1996 Goodno
5,622,390 A 4/1997 Jenkins
5,626,370 A 5/1997 Petkovsek
5,642,855 A 7/1997 Michlin
5,667,134 A 9/1997 Olson et al.
5,713,511 A 2/1998 Diamond
5,752,647 A * 5/1998 Schubert et al. ..... 229/92.1
5,950,909 A 9/1999 Peterson et al.
5,961,151 A 10/1999 Tung et al.
6,003,760 A 12/1999 Abercrombie
6,019,280 A 2/2000 Peterson
6,123,253 A 9/2000 Mehta et al.
6,126,064 A * 10/2000 Hutchinson ..... 229/92.1
6,129,389 A 10/2000 Younger
6,135,506 A 10/2000 Chess et al.
6,196,453 B1 3/2001 Hutchinson
6,412,687 B1 7/2002 Steitz
6,422,938 B1 * 7/2002 Steitz ..... 462/18
6,431,437 B1 8/2002 Lombardo et al.
6,557,748 B2 * 5/2003 Bethke ..... 229/92.1
7,083,079 B2 8/2006 Bethke
7,219,828 B2 5/2007 Lombardo
7,669,389 B2 3/2010 Butler
2004/0174013 A1 * 9/2004 Dyer ..... 283/116
2005/0252955 A1 11/2005 Sugai et al.
2006/0032896 A1 * 2/2006 Bethke et al. ..... 229/92.3
2007/0000978 A1 1/2007 Bethke
2008/0060240 A1 3/2008 Crum
2010/0193581 A1 8/2010 Dyer

* cited by examiner

DOUBLE PARALLEL FOLDED MAILER HAVING AN INTEGRATED RETURN POSTCARD

FIELD OF THE DISCLOSURE

The present disclosure relates generally to mailer forms and, more particularly, to a double parallel mailer having an integrated return postcard.

BACKGROUND

Mailers are commonly used for a variety of applications as an effective way to distribute information and come in a variety of different configurations. Such configurations may include a reply portion such as, for example, a return envelope, a return postcard, and/or detachable portions such as, for example, checks, etc. To reduce costs, self-mailer forms are typically formed from a single sheet of paper or stock to enable the various data, including indicia, to be printed on the form. The mailer form is folded to form a conventional sized letter or envelope that includes an outgoing address.

Mailers having reply postcards provide cost savings in postage charges. For example, the cost to mail a postcard using the United States Postal Service ("USPS") is less than the cost to mail a regular letter.

DETAILED DESCRIPTION

Figure 1A:
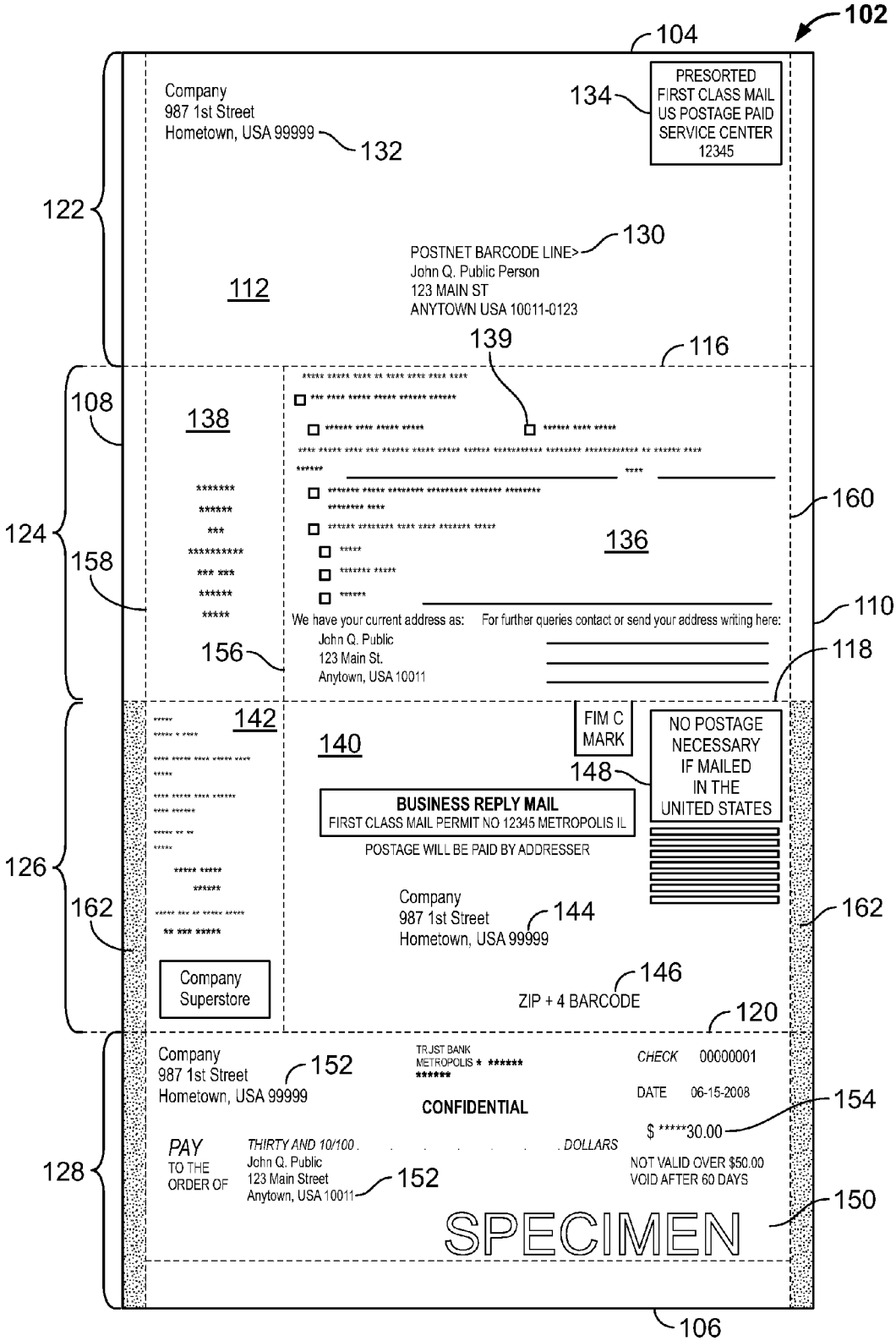
FIG. 1A is a top plan view of an example mailer showing a first side of the example mailer as described herein.

Return postcards advantageously provide substantial cost savings in postage charges over conventional letters. For example, the current cost to mail a postcard via the USPS is less than mailing a regular letter. Such cost savings provide an incentive to utilize postcards for a wide variety of specialized mailings.

However, postcards must meet certain USPS regulations. One such regulation requires mailing pieces serving as postcards to meet particular weight (pounds per surface area) or thickness requirements. Further regulations require the postcard to have a certain thickness, weight, and/or size so that the mail piece can travel through postal sorters or other various postal equipment without difficulties. For example, current USPS postcard regulations state that a postcard must have a height between 3.5 inches and 4.25 inches, a length between 5.0 inches and 6.0 inches, a thickness between 0.007 inches and 0.016 inches, and a weight of no more than 1 ounce. Thus, it is desirable for an outgoing mailer to itself qualify as a postcard to realize the postal mail savings for a postcard versus first class mail. However, such requirements often limit the use of postcards. For example, the thickness requirement may limit the types of printers with which such postcards can be utilized, making the use of postcards more difficult and undesirable.

An example mailer form described herein has a return postcard integrally formed with the form such that when fully assembled, the return postcard satisfies the USPS regulations and requirements such as, for example, weight, thickness and size requirements. To meet USPS postcard thickness requirements without limiting the type of printer that can be used, the mailer form and, thus, the return postcard, are formed from a single sheet of paper or stock. In contrast to known mailer forms having return postcards, the example mailer forms described herein are formed from a single sheet of paper having approximately one-half of the thickness of the minimum USPS required thickness requirements. In this manner, the single sheet enables various or custom indicia such as, for example, personalized customer information, to be printed on a first or single side of the form via for example, a laser printer, a personal printer, an industrial printer, and/or any other suitable printer.

The example mailer forms described herein include four panels having an integral return postcard (e.g., a business return postcard, a courtesy return postcard, etc.) formed from two adjacent panels when the form is folded as an outgoing mailer. For instance, in one example, the mailer forms include a first portion of a second panel and a first portion of a third panel that when folded are adhered together to represent respective first and second sides of the return postcard. A second side or face of the second and third panels include first adhesive portions that receive adhesive to adhere the second panel to the third panel to form a postcard adjacent to a receipt or other coupon when the form is folded as an outgoing mailer. The second and third panels also include second portions adjacent to the respective first portions representing respective first and second sides of a stub. The stub is detachable from the outgoing mailer and may be retained by the recipient. The first panel includes addressee indicia and the fourth panel may include, for example, a negotiable instrument such as, for instance, a rebate check. When the form is folded as an outgoing mailer, the fourth panel is disposed between the first panel and the second and third panels. Because the fourth panel is sandwiched within the four panel document when folded, confidentiality and show-through protection are assured.

Such configuration advantageously enables a user to print personalized data or information to a particular recipient onto the postcard and/or the stub portion by printing on only one side of the form when the form is fed through, for example, a laser printer. Such personalized information may include, for example, a recipient's name, account number, and/or other information on the form such as, for example, the return postcard and/or the detachable stub portion.

The information in the example mailer form may be human and/or machine readable information, which may be preprinted on the example form, printed on the form when the form is passed through a printer such as, for example, a laser printer, handwritten on the form, provided via a label, and/or any combination thereof.

Figure 1B:
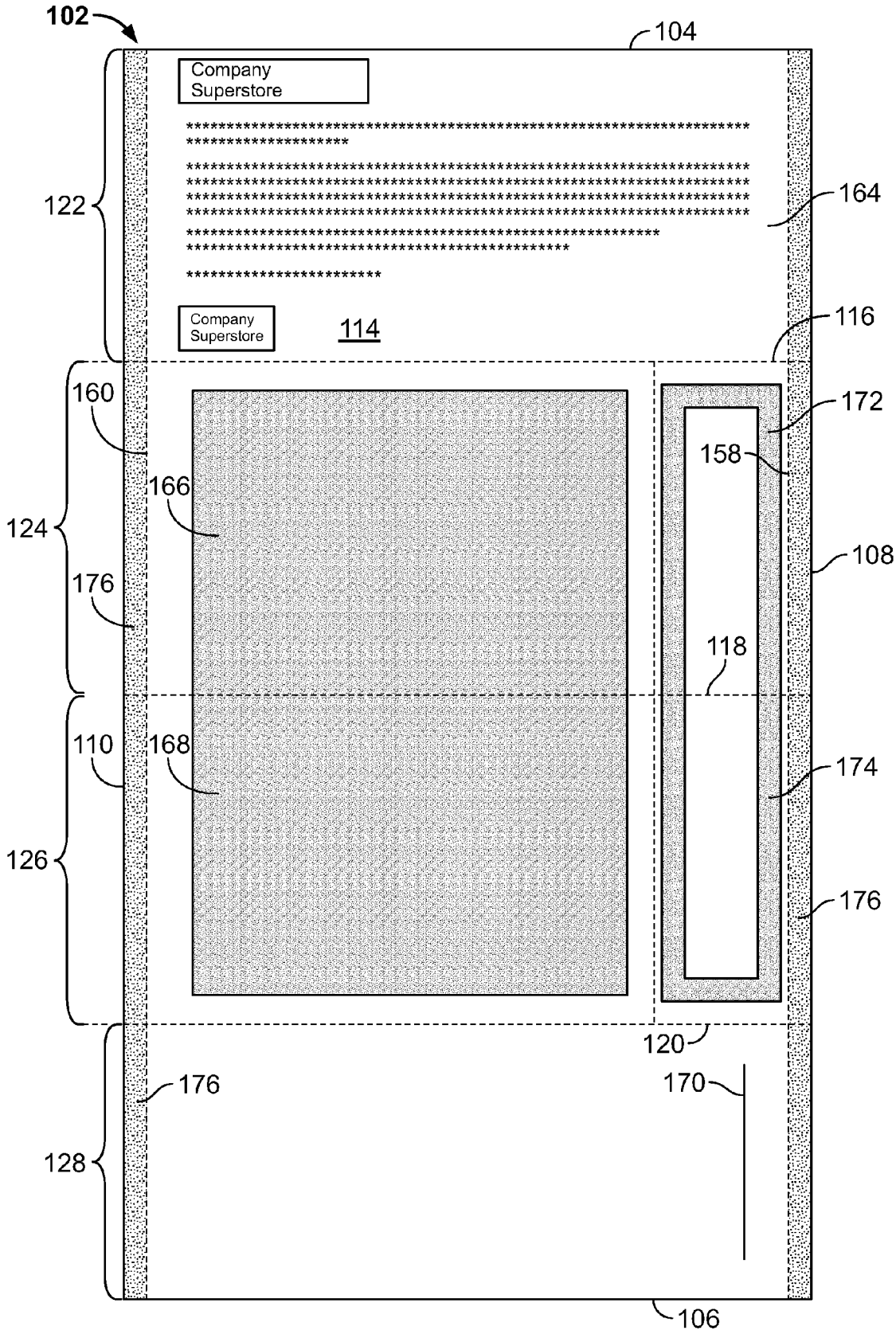
FIG. 1B is a bottom plan view of the example mailer of FIG. 1A showing a second side of the example mailer.

FIGS. 1A and 1B illustrate an example mailer form 102 described herein. Referring to FIGS. 1A and 1B, the example mailer 102 is formed from a single sheet of paper. In the example, the form 102 has approximately one half the thickness of a postcard meeting USPS requirements and regulations (e.g., 0.0035 inches thick). In one example, the form 102 is 14 inches in length by 8½ inches in width sheet of paper of sufficient weight or thickness so that a postcard separated from an outgoing mailer formed when the form 102 is double parallel folded can be properly handled by automated postal sorting equipment. In other examples, the form 102 may have any other suitable dimensions or sizes.

The example form 102 includes top and bottom edges 104, 106 and parallel first and second side edges 108 and 110, respectively. In this example, the top and bottom edges 104, 106 are substantially perpendicular to the side edges 108, 110. The form 102 further defines a front face or first side 112 (FIG. 1A) and a back face or second side 114 (FIG. 1B).

The example form 102 includes first, second, and third lines of weakness or fold lines 116, 118, 120. The example fold lines 116, 118, 120 are substantially parallel to the top and bottom edges 104, 106 and extend substantially transverse to, and at least partially between the side edges 108, 110 for dividing or forming the form 102 into four panels 122, 124, 126, 128. In this example, the first, second, and third fold lines 116, 118, 120 extend substantially the entire distance between the first and second side edges 108, 110 and each of the fold lines 116, 118, and 120 are substantially continuously formed. In other examples, at least one of the first, the second, or the third fold lines 116, 118, 120 may extend less than the entire distance between the first and second side edges 108, 110 and/or may be formed by at least two collinear fold lines. For example, the fold lines 116, 118, or 120 may be discontinuously formed. Thus, the first, second, third, and fourth panels 122, 124, 126, 128 in combination define the form 102 prior to folding as an outgoing mailer 400 described below in connection with FIGS. 4A and 4B. The first panel 122 is interconnected with the second panel 124 via the first fold line 116. The second panel 124 is interconnected with the third panel 126 via the second fold line 118. The third panel 126 is interconnected with the fourth panel 128 via the third fold line 120. The first, second, third and fourth panels 122, 124, 126, 128 are interconnected in a manner that enables the first, second, third, and fourth panels 122, 124, 126, 128 to be double parallel folded onto each other as explained in greater detail below.

In this example, the second and third panels 124 and 126 are substantially the same size (e.g., the same width and length), while the first panel 122 has a longitudinal length slightly larger or longer than the longitudinal length of the fourth panel 128. In other examples, the panels 122, 124, 126, 128 may be any suitable size such that when folded, the example form 102 forms a return postcard such as, for example, a return postcard 300 as described in connection with FIGS. 3, 8A and 8B. In still other examples, the panels 122, 124, 126, 128 may be configured in any suitable arrangement so that the form 102 may be folded as a Z-fold configuration, a C-fold configuration, and/or any other suitable fold configurations.

With reference to the illustrated example, the first panel 122 is disposed as the top panel of the example form 102. The second panel 124 is disposed as the second panel of the example form 102. The third panel 126 is disposed as the third panel of the example form 102 so that the second panel 124 is between the first and third panels 122, 126. The fourth panel 128 is disposed as the bottom panel of the example form 102 so that the third panel 126 is between the second and fourth panels 124, 128.

The first, second, third, and/or fourth panels 122, 124, 126, 128 may include human and/or machine readable indicia that may be pre-printed on the example form 102, printed when the form 102 is passed through a printer such as, for example, a laser printer, handwritten on the form 102, provided via a label, and/or any combination thereof. Additionally or alternatively, the first, second, third, and/or fourth panels 122, 124, 126, 128 may include personalized information relating to a particular recipient/customer of the example form 102 and/or any other suitable information. In some examples, each of the first, second, third and/or fourth panels may be left blank. Furthermore, in this example, the panel 128 may include confidential information and, as explained in detail below, the fourth panel 128 is disposed between the first panel 122 and the second and third panels 124, 126 when folded as the example outgoing mailer 400, thereby assuring confidentially and show-through protection. In this example, the first side 112 of the first panel 122 includes human and/or machine readable indicia such as, for example, outgoing address indicia 130 (e.g., recipient's address, postal address bar coding, etc.), return address indicia 132, and postage indicia 134. Alternatively, the outgoing address 130, return address indicia 132, and the postage indicia 134 may receive, for example, a label.

Figure 8A:
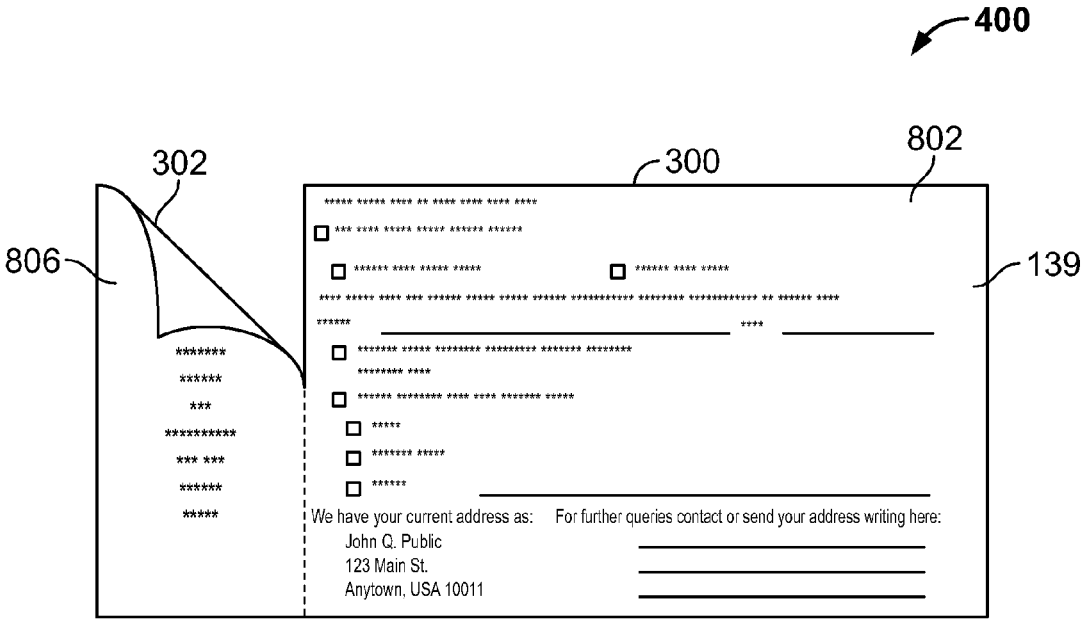
FIGS. 8A and 8B illustrate a first side and a second side of a return postcard and a stub removed from the example outgoing mailer, respectively.

In the example, the first side 112 of the second panel 124 includes a first portion 136 adjacent a second portion 138. The first portion 136 of the second panel 124 forms a first side or face 802 (as shown in FIG. 8A) of the postcard 300. In the example, the first face 802 of the postcard 300 includes human and/or machine readable information according to the type of return postcard provided. Such information may include, for example, a survey, request for promotional discounts or rebates, purchase request, etc, or may be left blank. For example, in one example, the first portion 136 may include extended warranty information, a request for additional information relating to the extended warranty, and/or a request for information or rebate information for various products. In other examples, the postcard 300 may be a business reply postcard, a courtesy reply postcard and/or any other suitable postcard.

Additionally or alternatively, in another example, the first portion 136 may include personalized information relating to a particular recipient/customer of the example form 102. For example, the first portion 136 may include truncated credit card information and/or authorization signature line to purchase a product or service such as, for example, extended warranty coverage for a purchased item. In yet another example, the first portion 136 may also include the recipient's name, address information, other personal information, and/or a section to correct such information if it is incorrect. Furthermore, the first portion 136 may include check-off indicia 139 to optimize the possibility that the recipient (the outgoing addressee) will complete and return the postcard 300 of the outgoing mailer 400.

The example second portion 138 of the second panel 124 forms a first side or face 806 (FIG. 8A) of a stub 302 described below in FIG. 3 that is detachable from the postcard 300. For example, the first face 806 of the detachable stub 302 may include instructional information, receipt information, personalized information, etc., may be a coupon or promotional information, and/or may be left blank. Similar to the second panel 124, the third panel 126 is, in this example, divided into a first portion 140 and a second portion 142. The first portion 140 forms a second side or face 804 (FIG. 8B) of the postcard 300 and may include information such as, for example, return address indicia 144, address bar code information 146, postage indicia 148, and/or any other suitable indicia or information.

The second portion 142 may form a second side or face 808 (FIG. 8B) of the detachable stub 302. In the illustrated example, the second portion 142 is a rebate stub detachable from the postcard 300 to be kept by the recipient as a receipt. The second portion 142, however, may include any information such as, for example, headings, titles, logos, and/or any other suitable information, may include a coupon or other promotional information, and/or may be left blank. Additionally or alternatively, the second portion 142 may include personalized information tailored specifically for each recipient that is to receive the example mailer 400. Such information may include, for example, a customer name, an item name and model number of the purchased item, a date of purchase, a method of payment, a rebate amount, a date the rebate was paid, and/or any other suitable personalized information.

In the illustrated example, the first portions 136, 140 have lengths and widths that may be approximately 3.5 to 4.25 inches in height by 5 to 6 inches in length to comply with USPS regulations. However, in other examples, the first portions 136, 140 may include any other suitable dimensions or sizes.

As noted above, the fourth panel 128 is disposed between the first panel 122 and the second and third panels 124, 126 when the form 102 is folded as the outgoing mailer 400. Thus, any information, including confidential information, may be included in panel 128 because confidentially and see-through protection is assured. For example, in the illustrated example, the panel 128 comprises a negotiable instrument such as, for example, a rebate check 150. For example, the fourth panel 128 may include pre-printed information such as, for example, payor and payee information 152, an amount 154 of the negotiable instrument, etc. Other human or machine readable indicia may also be printed or pre-printed on the first side 112 of the fourth panel 128 such as, for example, the date of the instrument, check number, financial institution address indicia, and/or any other suitable and/or required information. Additionally and/or alternatively, in other examples, the fourth panel 128 may include a gift receipt, a gift card, a coupon, an informational display, any suitable information, etc., and/or may be eliminated.

As shown, the example form 102 includes a line of weakness 156 that is disposed between the first portions 136, 140 and the second portions 138, 142 of the second and third panels 124, 126. Additionally or alternatively, the example form 102 includes lines of weakness 158, 160 adjacent and substantially parallel to the side edges 108, 110, respectively. In this example, adhesive patterns 162 are disposed in the area between the edges 108, 110 and the respective lines of weakness 158, 160 for holding the panels 122, 124, 126, 128 together when the form 102 is folded about the fold lines 116, 118, 120. In the example, the adhesive patterns 162 are a pressure activatable adhesive.

Referring to FIG. 1B, in this example, the second side 114 of the first panel 122 includes preprinted information 164. The preprinted information 164 may include, for instance, a letter, an instruction, a notice, and/or any other suitable information. The second side 114 of the first portion 136 of the second panel 124 and/or the second side 114 of the first portion 140 of the third panel 126 include adhesive areas 166, 168. Similarly, in other examples, the second side 114 of the second portions 138, 142 of the second and the panels 124, 126 may also include second adhesive areas 172, 174. Also, in this example, similar to the first side 112, the second side 114 may include adhesive patterns 176 (e.g., pressure activatable adhesive) disposed in the area between the edges 108, 110 and the respective lines of weakness 158, 160 for holding the panels 122, 124, 126, 128 together when the form 102 is folded about the fold lines 116, 118, 120. The example second side 114 of the fourth panel 128 includes a signature area 170 to endorse the negotiable instrument.

By utilizing a pressure activated adhesive, the example form 102 may be processed through a printer without having the adhesive impair or damage the printer because the rollers of a printer do not apply sufficient pressure to the form 102 to activate the adhesive. When folded via, for example, a folding machine, the folded form 102 is passed through a roller or other pressure applying devices that apply sufficient pressure to active the adhesive on the adhesive areas 162, 166, 168, 172, 174 and/or 176 to secure or hold the folded form 102 as the example outgoing mailer 400 shown in FIGS. 4A and 4B. However, in other examples, the adhesive patterns 162 may include a variety of different adhesives such as, for example, rewettable adhesive, heat activated adhesive, and/or any other suitable adhesive or chemical fastening substance(s).

The example lines of weakness or fold lines 116, 118, 120, 156, 158, 160 may be any suitable type, including, for instance, perforation lines, die cut lines, scores or creases, etc., to facilitate folding of the example form 102 and/or removal of the various panels by an end user or recipient of the form 102. Furthermore, the example form 102 described herein is not limited to the described series and orientations of panels, and may be reversed or changed in any suitable manner. The indicia or information on the first, second, third, or fourth panels 122, 124, 126, 128 can be inverted from the orientation shown. In this regard, when the form 102 is folded to form an outgoing mailer (e.g., the outgoing mailer 400), the indicia provided on the first side 112 of the second panel 124 will be inverted relative to the indicia provided on the first side 112 of the third panel 126. If it is desired to have the indicia on each face 802, 804 of the return postcard 300 commonly orientated, either the indicia on the first side 112 of the second panel 124 or the indicia on the first side 112 of the third panel 126 may be inverted so that when the form 102 is folded as the example outgoing mailer 400, the indicia is commonly orientated in relation to each face 802, 804 of the postcard.

Figure 2:
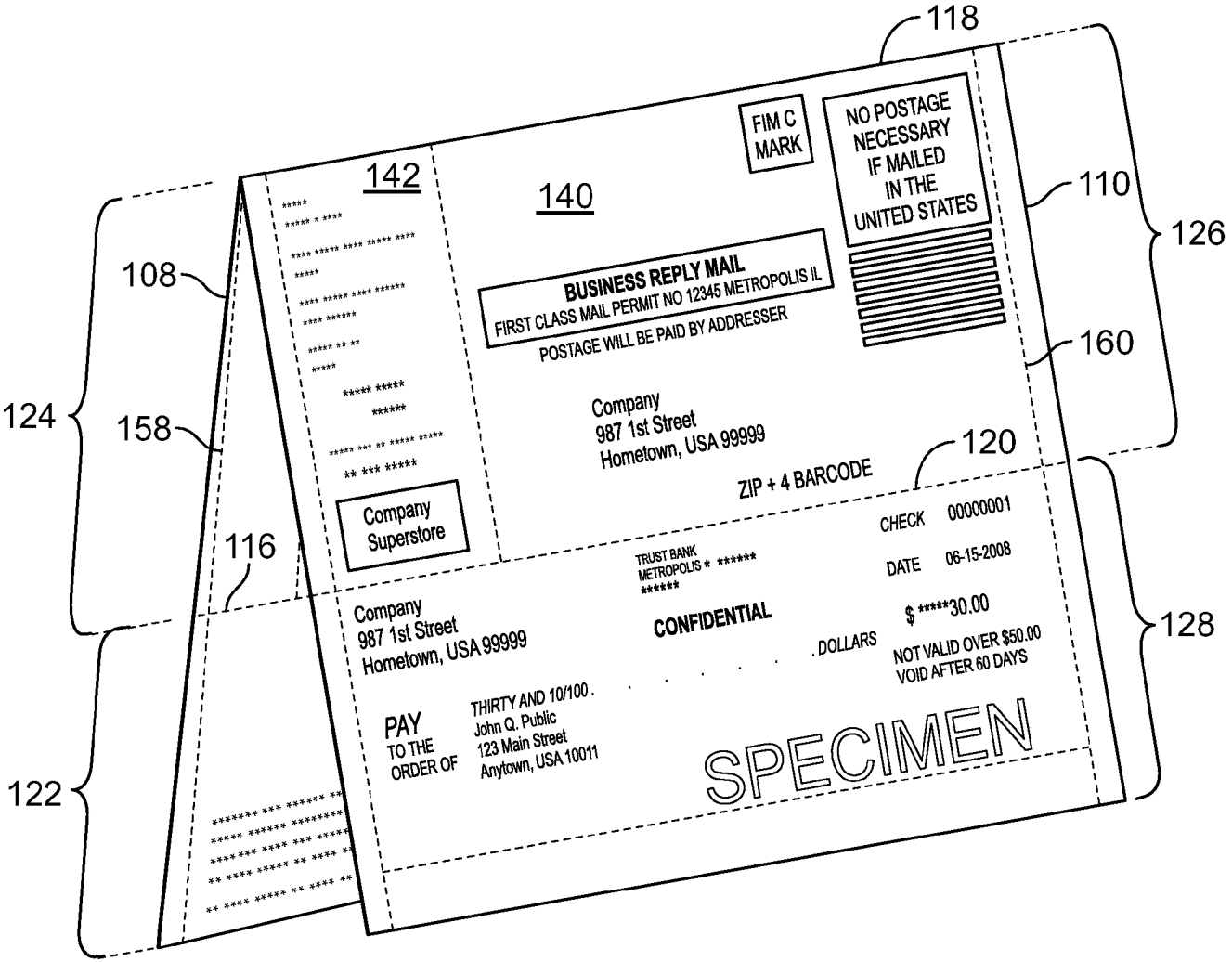
FIGS. 2 and 3 illustrate the example mailer of FIGS. 1A and 1B folded along a first fold line.
Figure 3:
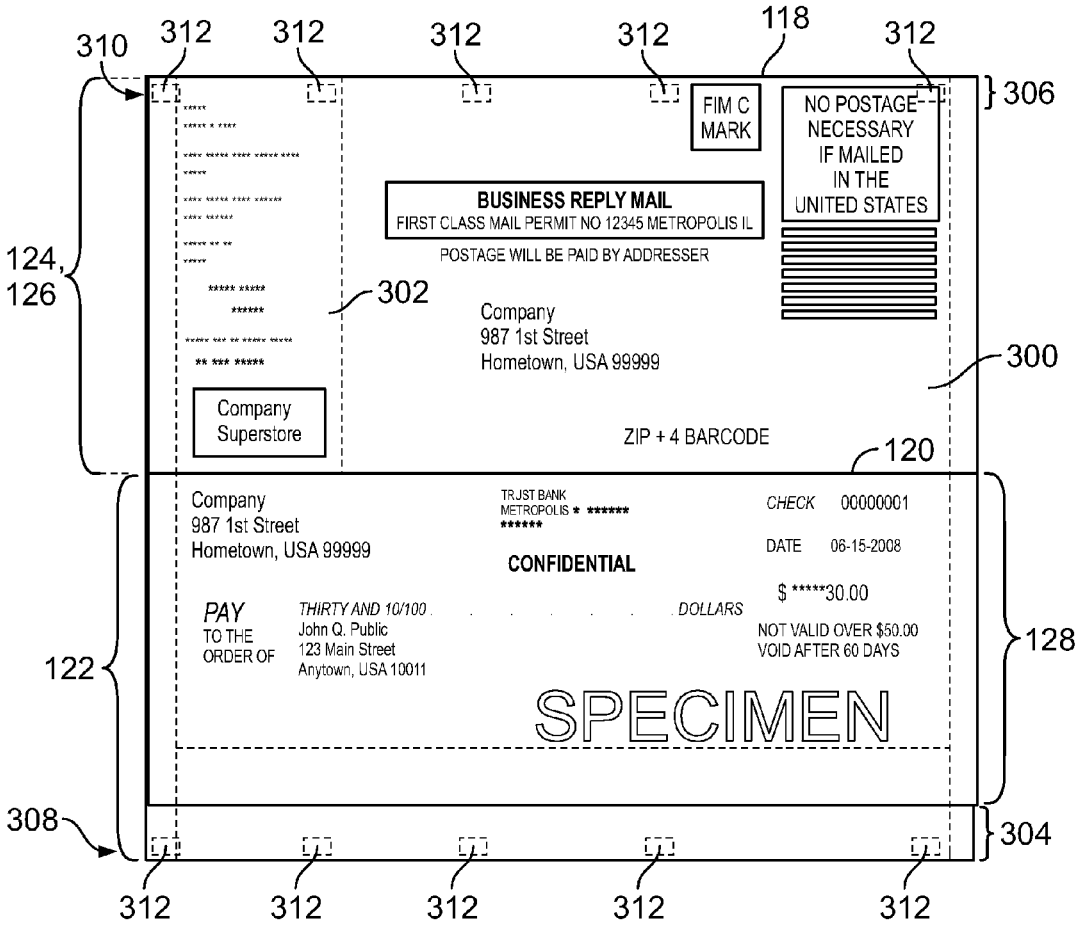

Referring to FIGS. 2 and 3, the example form 102 is shown being folded about the fold line 118. As shown, when the example form 102 is folded about the fold line 118, the adhesive area 166 of the second side 114 of the second panel 124 is folded onto the adhesive area 168 of the second side 114 of the third panel 126 to form the return postcard 300. At least a portion of the second panel 124 is adhered to at least a portion of the third panel 126 so that the mutually attached portions of the second and third panels 124, 126 each comprise one ply or layer of the postcard 300. Also, when the example form 102 is folded, the second portions 138, 142 of the second and third members 124, 126 form the stub portion 302.

In the illustrated example, the adhesive areas 166, 168 is a permanent adhesive such as a pressure seal adhesive, cohesive, and/or any other suitable fastening substance. The adhesive forms the postcard 300 upon folding the form 102 and the application of suitable pressure to the adhesive areas 166, 168. In the illustrated example, the adhesive areas 166, 168 are substantially continuous to preclude delamination of the return postcard 300. However, in other examples, the adhesive areas 166, 168 may be provided as a plurality of discontinuous elements and/or may be disposed in any suitable pattern, shape, or density.

When folded along the fold line 118, the second side 114 of the fourth panel 128 is similarly folded onto the second side 114 of the first panel 122 so that the fold lines 116 and 120 substantially align. The first panel 122 and the fourth panel 128 are then folded about fold lines 116, 120, as will be described below, so that the first side 112 of the fourth panel 128 is folded onto the first side 112 of the third panel 126 and between the first panel 122 and the third panel 126. In this manner, the fourth panel 128 (e.g., the rebate check 155) is sandwiched within the example outgoing mailer 400 so that confidentiality and show-through protection is assured.

Additionally, as noted above, in this example, the first panel 122 is slightly larger than the fourth panel 128. In this manner, a portion 304 of the second side 114 of the first panel 122 that is larger than the fourth panel 128 engages at least a portion 306 of the front side 112 of the third panel 126 when the first and fourth panels 122, 128 are folded about the fold lines 116, 120. To provide additional security to hold the panels 122, 124, 126, 128 together as the example outgoing mailer 400, the portion 304 of the second side 114 of the first panel 122 includes a first adhesive pattern 308 that engages a second adhesive pattern 310 on the first side 112 of the third panel 126 adjacent to the fold line 118. The adhesive patterns 308, 310 are shown as tabs 312 having, for example, pressure activated adhesive, for holding the form 102 together when the form 102 is folded as the example outgoing mailer 400. The adhesive is of the type and/or pattern so that the panels that are held together by the tacking adhesive may be readily separated without significantly destroying the panels 122, 124, 126, 128. In other examples, the portions 304, 306 may include adhesive strips, adhesive spots, and/or any other suitable adhesive or chemical fastening substance.

Figure 4A:
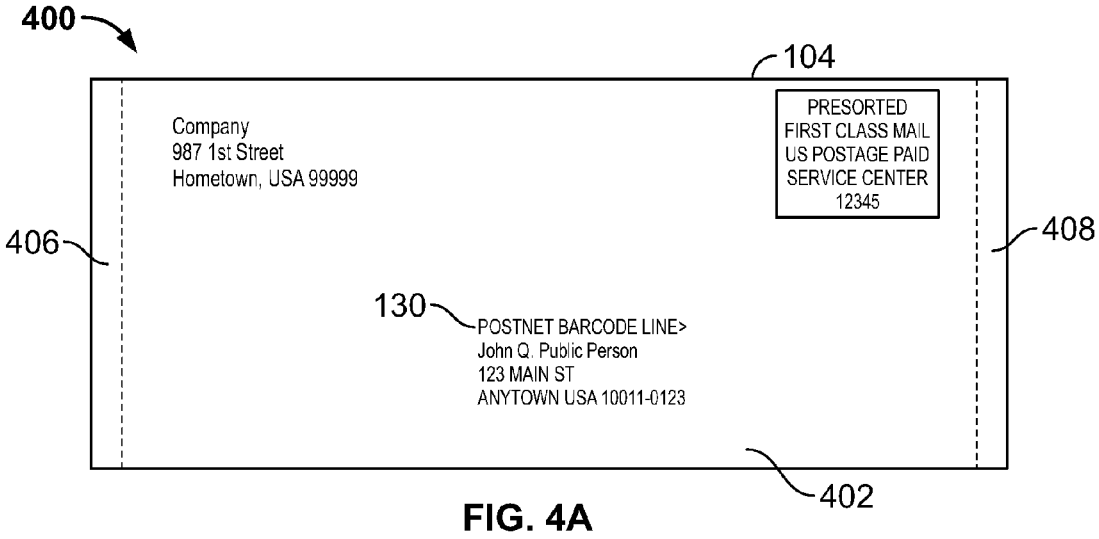
FIG. 4A illustrates a front side of an example outgoing mailer configured when folding the example mailer of FIGS. 1A, 1B, 2, and 3 along a second fold line.
Figure 4B:
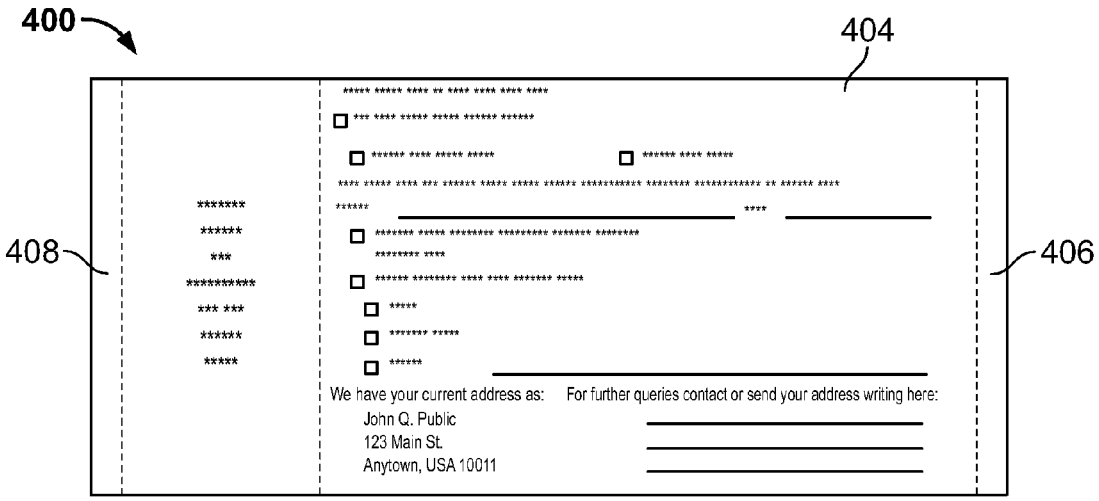
FIG. 4B illustrates a back side of the example outing mailer of FIG. 4A.

Turning to FIGS. 4A and 4B, the form 102 of FIGS. 1A, 1B, 2, and 3 is illustrated when folded as the example outgoing mailer 400. The example outgoing mailer 400 includes a first side or front face 402 and a second side or back face 404. When the example form 102 is folded as the outgoing mailer 400, the first panel 122 forms the front face 402 of the outgoing mailer 400 and the second panel 124 forms the back face 404 of the outgoing mailer 400. The third and fourth panels 126, 128 are folded within the outgoing mailer 400 between the first and second panels 122, 124, and in this instance, completely hidden from view. The area between the lines of weakness 158, 160 adjacent the respective side edges 108, 110 define tear off strips 406, 408 when the example form 102 is folded as the outgoing mailer 400. As noted above, in this example, the area between the side edges 108, 110 and the lines of weakness 158, 160 includes pressure activated adhesive that holds the outgoing mailer 400 together. The strips 406, 408 may also prevent unauthorized tampering of the outgoing mailer 400. The outgoing mailer 400 is sent and delivered to the recipient indicated in the outgoing addressee indicia 130 on the first panel 122 via USPS or any other suitable delivery service.

Figure 5:
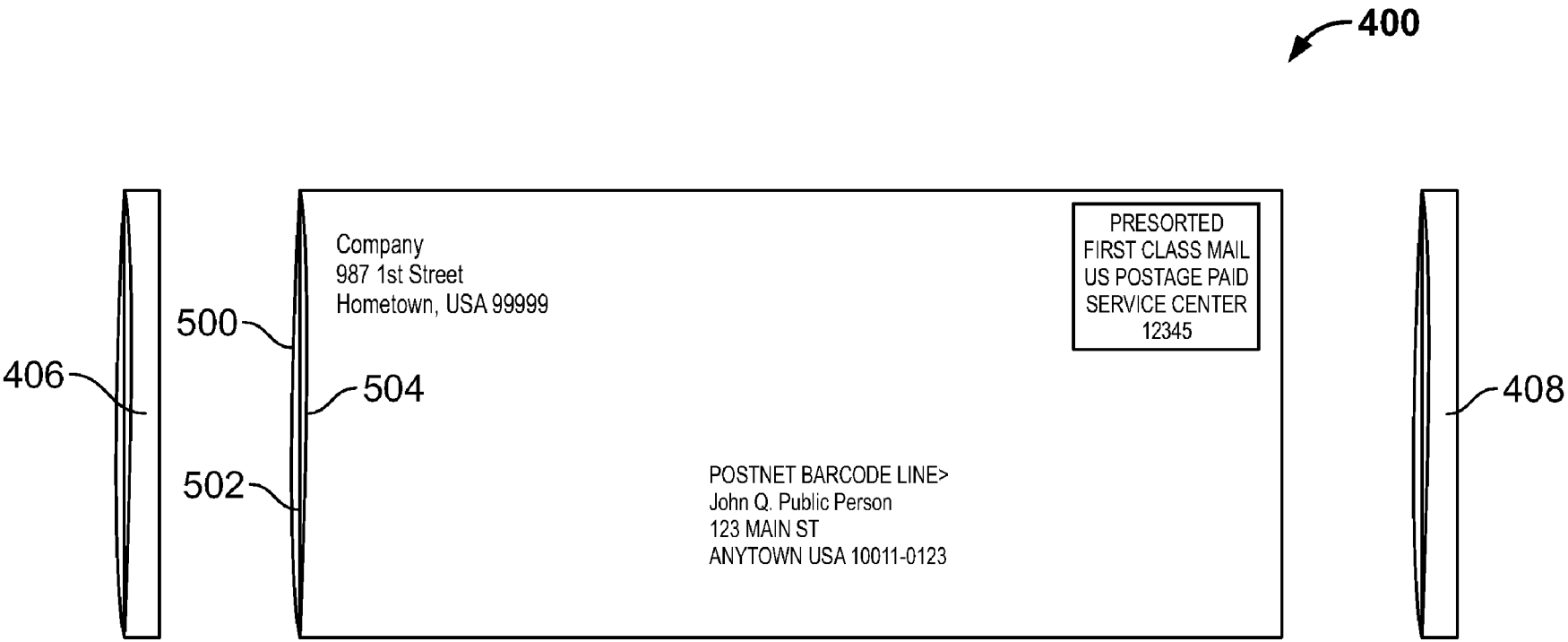
FIG. 5 illustrates the example outgoing mailer of FIGS. 4A and 4B showing example tear-off strips removed.

Referring to FIG. 5, the example outgoing mailer 400 includes a first ply 500, a second ply 502, and a third ply 504. The first ply 500 being defined by the permanently adhered second and third panels 124, 126 and the second and third plies 502, 504 being defined by the fourth and first panels 128, 122 respectively. The second side 114 of the first panel 122 is the back face of the third ply 504, while the second side 114 of the fourth panel 128 forms a front face of the second ply 502. The first side 112 of the third panel 126 forms the front face of the first ply 500 and the first side 112 of the second panel 124 forms the back face of the first ply 500.

To open the example outgoing mailer 400, the recipient removes the tear-off strips 406, 408. The recipient can then open the outgoing mailer 400 to separate the second and third plies 502, 504 from the first ply 500 having the postcard 300 and the stub 302 by using a finger, pencil, letter opener, or otherwise by disrupting the adhesive tabs 312 and detaching the third ply 504 (i.e., the first panel 122) from the portion 306 of the first ply 500 (i.e., the third panel 126) without destroying the plies 500, 502, 504.

Figure 6A:
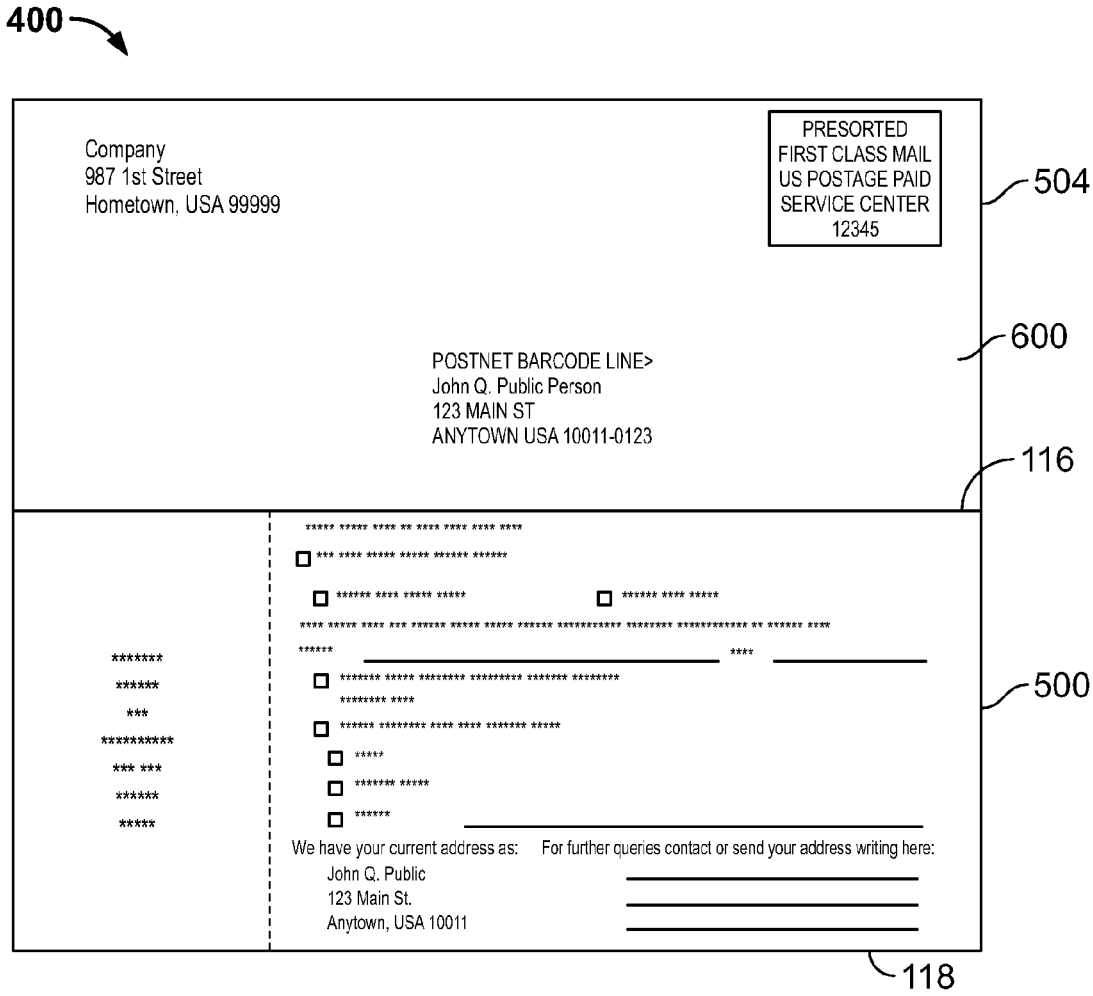
FIG. 6A illustrates a first side of the example outgoing mailer of FIGS. 4A, 4B, and 5 when the mailer is opened along the first folding line.
Figure 6B:
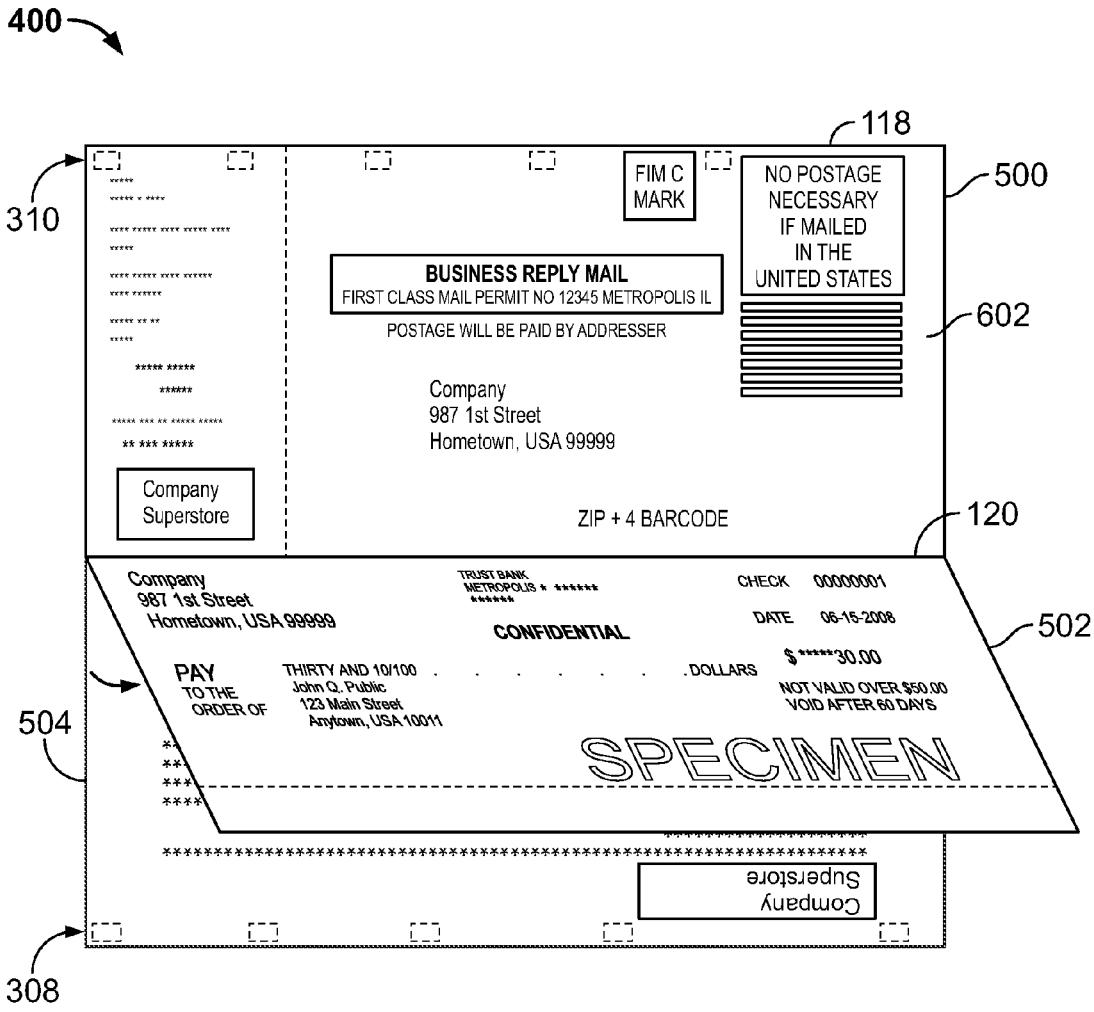
FIG. 6B illustrates a second side of the example outgoing mailer of FIG. 6A.

FIGS. 6A and 6B illustrate a front 600 and a back 602 of the example outgoing mailer 400 when the second and third plies 502, 504 are separated from the first ply 500 when the outgoing mailer 400 is opened along the first fold line 118.

Figure 7A:
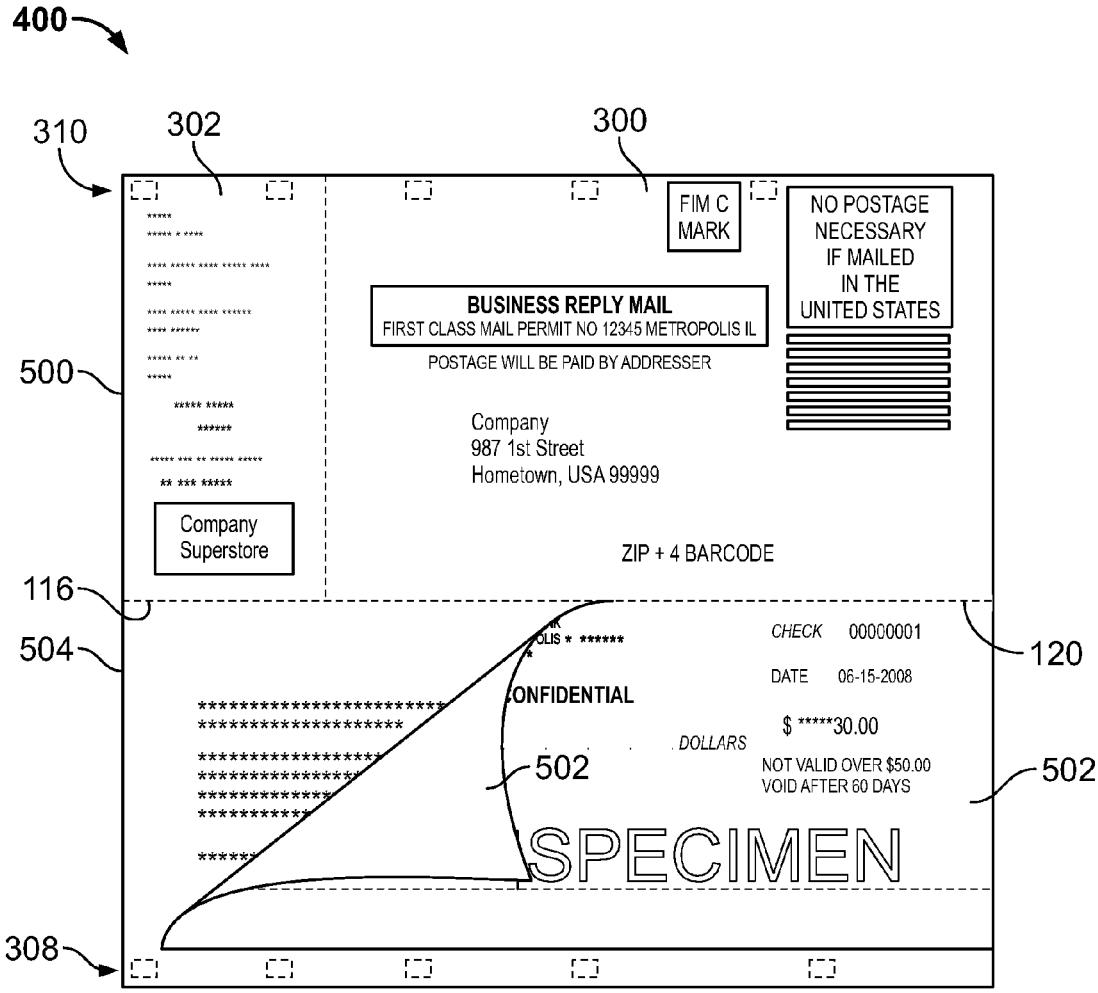
FIGS. 7A and 7B illustrate the example outgoing mailer of FIGS. 4A, 4B, 5, 6A and 6B showing a fourth panel and a first panel removed from the example outgoing mailer, respectively.
Figure 7B:
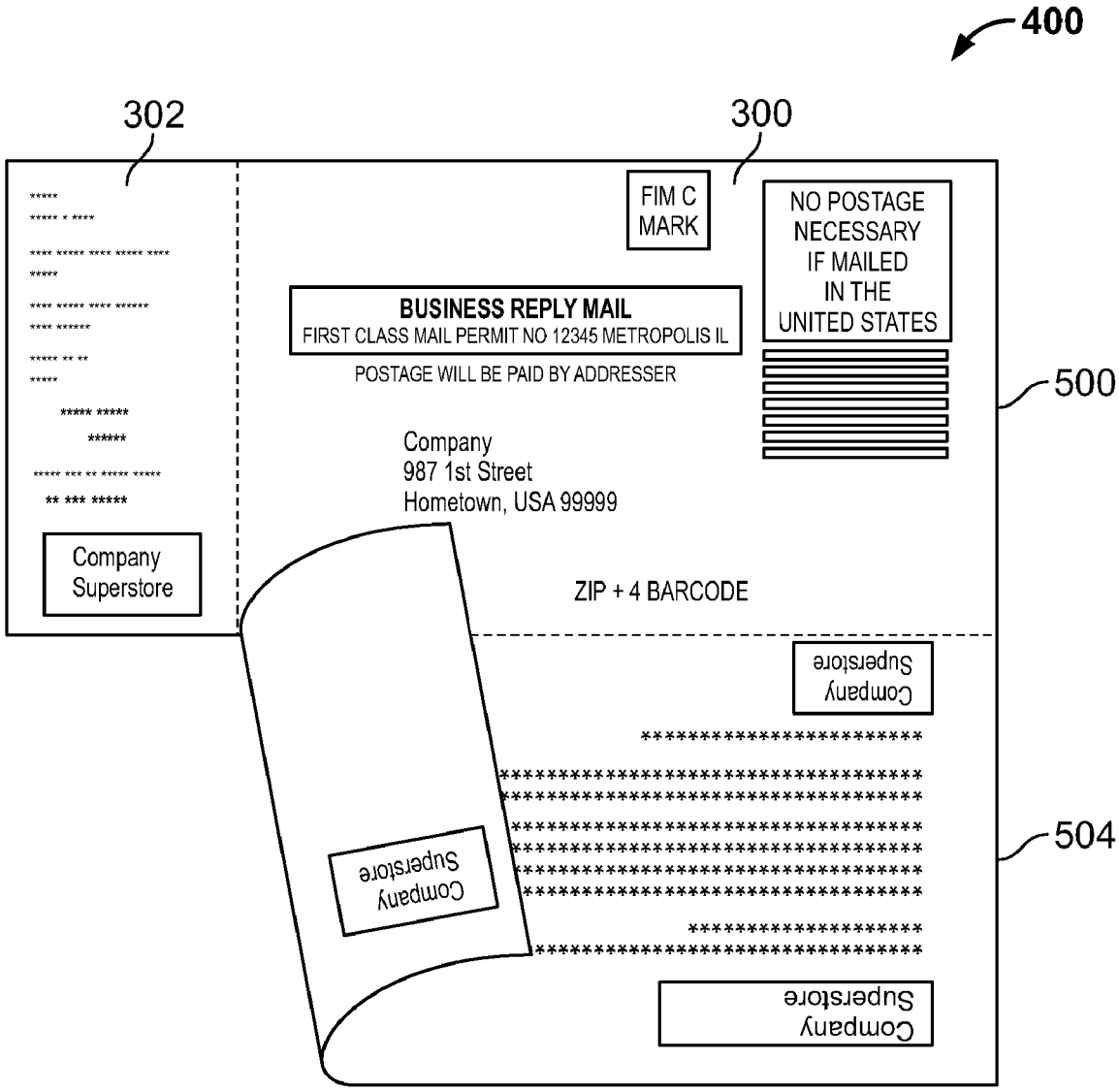

FIGS. 7A and 7B illustrates the example outgoing mailer 400 showing the second ply 502 (i.e., the fourth panel 128) removed from the example outgoing mailer 400 and the third ply 504 (i.e., the first panel 122) removed from the example outgoing mailer 400, respectively.

Figure 8B:
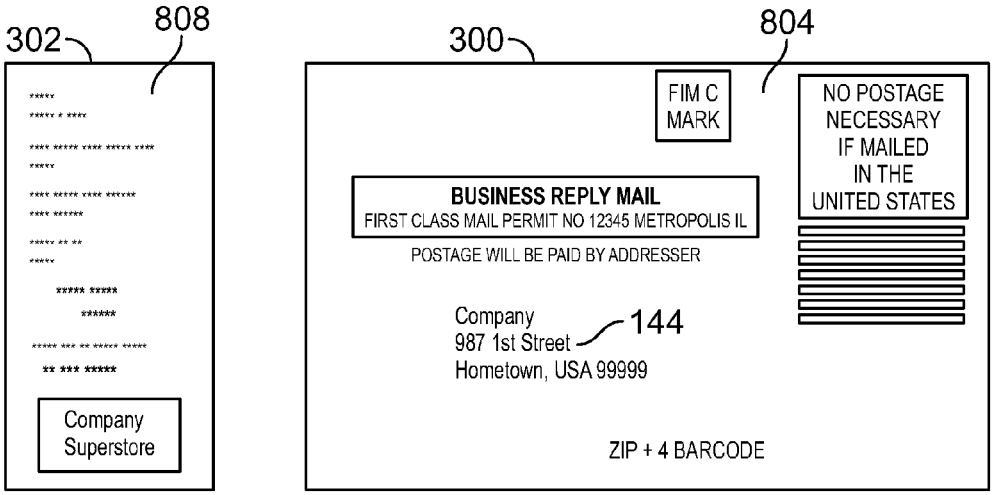

FIGS. 8A and 8B illustrate the first side or face 802 and the second side or face 804 of the return postcard 300 and the first face 806 and the second face 808 of the stub 302. The stub 302 is removed or detached from the postcard 300 along the line of weakness 156 (FIG. 1A). Once the return postcard 300 has been separated from the stub 302 and the outgoing mailer 400, the recipient may fill out any information and/or check list information 139 if necessary and/or desired. The postcard 300 may then be deposited with the USPS and delivered to the reply address 144. The postcard 300 will comply with the USPS requirements because the weight and thickness of the postcard 300 is sufficient for postal machine processing.

Although certain example apparatus and articles of manufacture have been described herein, the scope of coverage of this patent is not limited thereto. On the contrary, this patent covers all apparatus and articles of manufacture fairly falling within the scope of the appended claims either literally or under the doctrine of equivalents.

What is claimed is:

1. A form comprising:

a first panel, a second panel, a third panel, and a fourth panel defining a sheet prior to folding the form, the first panel and the second panel being interconnected at a first fold line, the second panel and the third panel being interconnected at a second fold line, and the third panel and the fourth panel being interconnected at a third fold line in a manner that enables the first, second, third, and fourth panels to be double parallel folded onto each other, each of the panels having a front surface and a back surface, the second and third panels being substantially the same size and the first panel being slightly larger than the fourth panel so that a portion of the first panel that is larger than the fourth panel engages at least a portion of the front surface of the third panel when the sheet is folded as an outgoing mailer;

the first panel including outgoing address indicia on a portion of the front surface of the first panel, wherein the front surface of the first panel defines a front face of the outgoing mailer when the form is folded; and the second and third panels being permanently coupled together when the form is folded to form a return postcard, detachable from the first and fourth panels;

the front surface of the second panel having a first portion that forms a first side of the postcard and a second portion adjacent the first portion and detachable from the first portion, and the front surface of the third panel having a third portion that forms a second side of the postcard and a fourth portion adjacent the third portion and detachable from the third portion.

2. A form as described in claim 1, wherein at least a portion of the back surface of the second panel and at least a portion of the back surface of the third panel provides a first adhesive pattern to adhere the second panel and the third panel to form the postcard.

3. A form as described in claim 1, further comprising a second adhesive pattern along at least a portion of the perimeter of the form.

4. A form as described in claim 1, wherein when folded as the outgoing mailer, the front face of the first panel forms a first side of the outgoing mailer and the front face of the second panel forms a second side of the outgoing mailer.

5. A form as described in claim 1, wherein at least one of the front face of the third panel or the second face of the first panel includes at least one adhesive tab for holding the form together when folded as the outgoing mailer.

6. A form as described in claim 1, wherein the form includes indicia that is to be printed on one side of the form.

7. A form as described in claim 1, wherein the form is between 0.0035 inches thick and 0.008 inches thick.

8. A form as described in claim 1, wherein the fourth panel comprises a negotiable instrument.

9. A form as described in claim 8, wherein confidential information located on the front surface of the negotiable instrument is concealed by the second and third panels layered adjacent the front surface of the negotiable instrument and by the first panel layered adjacent the back surface of the negotiable instrument when the form is folded as the outgoing mailer.

10. A form, comprising:

a quadrate sheet of paper having a first face opposite a second face, substantially parallel top and bottom edges, and substantially parallel first and second side edges, wherein the first and second side edges are substantially perpendicular to the top and bottom edges; and at least first, second, and third fold lines substantially parallel to the top and bottom edges to divide the sheet into at least first, second, third, and fourth panels, wherein the second face of the second panel and the second face of the third panel fold onto each other to form a postcard when the sheet is double parallel folded about the fold lines, wherein at least a first portion of the second face of the second panel and at least a second portion of the second face of the third panel include a first adhesive area to couple the second panel and third panel when the sheet is folded along the fold lines, and wherein a portion of the second face of the first panel engages a portion of the first face of the third panel when the sheet is folded along the fold lines.

11. A form as described in claim 10, wherein the sheet of paper is between 0.0035 inches thick and 0.008 inches thick.

12. A form as described in claim 10, further comprising a fourth adhesive area having at least one adhesive tab for holding substantially aligned edges of at least a portion of the second face of the first panel and the first face of the third panel together when the sheet is folded as an outgoing mailer.

13. A form as described in claim 10, further comprising adhesive patterns comprising pressure activatable adhesive.

14. A form as described in claim 10, further comprising a detachable stub formed by at least a portion of the second panel and at least a portion of the third panel when the second panel and the third panel are folded together.

15. A form as described in claim 14, further comprising a fifth adhesive area to couple the portion of the second panel and the portion of the third panel that form the detachable stub when folded together.

16. A form as described in claim 10, further comprising a first line of weakness adjacent and substantially parallel to the first side edge and a second line of weakness adjacent and substantially parallel to the second side edge.

17. A form as described in claim 16, wherein the first and second lines of weakness adjacent the side edges define first and second tear-off strips, respectively, when the form is folded as an outgoing mailer.

18. A form as described in claim 16, further comprising a second adhesive area between the first side edge and the first line of weakness and a third adhesive area between the second side edge and the second line of weakness.

19. A form for forming a mailer having a postcard integrally formed therein, comprising:

a sheet of paper having first and second faces, first and second side edges, and top and bottom edges;

a first line of weakness extending substantially transverse to the side edges and extending at least partially between the first side edge and the second side edge to form a first panel;

a second line of weakness extending substantially transverse to the side edges and extending at least partially between the first side edge and the second side edge adjacent to the first line of weakness to form a second panel adjacent the first panel;

a third line of weakness extending substantially transverse to the side edges and extending at least partially between the first side edge and the second side edge adjacent to the second line of weakness to form a third panel adjacent the second panel and a fourth panel adjacent the third panel; and the sheet is so dimensioned so that when folded about the first, second, and third lines of weakness to form a mailer, a portion of the second panel and a portion of the third panel form a detachable postcard, wherein the first face of the fourth panel contains confidential information that faces towards the detachable postcard and away from the first panel when the sheet is folded as the mailer.

20. A form as described in claim 19, wherein at least a portion of the second face of the second panel includes a first adhesive area to receive adhesive to adhere the postcard portion formed by the second panel and third panel when the form is folded as the mailer.

21. A form as described in claim 19, wherein the second panel and third panel include second portions adjacent to the postcard portions that form a stub when the second panel is folded onto the third panel, wherein the stub is detachable from the postcard.

22. A form as described in claim 19, wherein the form is between 0.0035 inches thick and 0.008 inches thick.

23. A form as described in claim 19, wherein the first, the second, and the third lines of weakness extend substantially the entire distance between the first and second side edges.

24. A form as described in claim 19, wherein at least one of the first line of weakness, the second line of weakness, or the third line of weakness is formed by at least two collinear lines of weakness.

* * * * *